US006892962B2

(12) United States Patent
Hurley et al.

(10) Patent No.: US 6,892,962 B2
(45) Date of Patent: May 17, 2005

(54) FUEL OIL ATOMIZER AND METHOD FOR ATOMIZING FUEL OIL

(75) Inventors: John F. Hurley, Easton, CT (US); John N. Dale, Stratford, CT (US); Scott H. Lindemann, Oxford, CT (US)

(73) Assignee: Combustion Components Associates, Inc., Monroe, CT (US)

( * ) Notice: Subject to any disclaimer, the term of this patent is extended or adjusted under 35 U.S.C. 154(b) by 150 days.

(21) Appl. No.: 10/282,314

(22) Filed: Oct. 28, 2002

(65) Prior Publication Data

US 2003/0080215 A1 May 1, 2003

Related U.S. Application Data

(60) Provisional application No. 60/340,932, filed on Oct. 29, 2001.

(51) Int. Cl.[7] ..... B05B 7/10

(52) U.S. Cl. ..... 239/406; 239/403; 239/405; 239/556; 239/601

(58) Field of Search ..... 239/403, 399, 239/405, 406, 463, 556, 558, 492, 601

(56) References Cited

U.S. PATENT DOCUMENTS

| | | | | |
|---|---|---|---|---|
| 4,141,505 A | * | 2/1979 | Reich | 239/431 |
| 4,356,970 A | * | 11/1982 | Vosper et al. | 239/403 |
| 5,353,992 A | * | 10/1994 | Regueiro | 239/601 |
| 5,826,798 A | | 10/1998 | Schindler | |
| 5,860,600 A | | 1/1999 | Schindler | |

* cited by examiner

*Primary Examiner*—Steven J. Ganey
(74) *Attorney, Agent, or Firm*—Barry R. Lipsitz; Douglas M. McAllister

(57) ABSTRACT

The present invention provides specific design dimensions for a sprayer plate flow restrictor orifices of a fuel oil atomizer, and the resulting arrangement of the atomized liquid spray pattern. Specific depth to diameter ratios of the sprayer plate restrictor orifices and specific dimensions of the chamfer of the inlets to the restrictor orifices of the atomizer of the present invention provide improved performance results as compared to prior art atomizers, including reduced emissions and increased durability of atomizer components.

8 Claims, 10 Drawing Sheets

FUEL OIL ATOMIZER AND METHOD FOR ATOMIZING FUEL OIL

This application claims the benefit of U.S. provisional patent application No. 60/340,932 filed on Oct. 29, 2001, which is incorporated herein and made a part hereof by reference.

BACKGROUND OF THE INVENTION

The present invention relates generally to the combustion of fuel oil, and more particularly to the atomization of fuel oil in a combustion furnace. In particular, the present invention provides improved apparatus and methods for discharging atomized fuel which provide low levels of air pollution emissions, such as oxides of nitrogen (NOx), carbon monoxide (CO), particulate matter (PM) and opacity. The present invention also provides improved durability over prior art atomizers.

For environmental and economic reasons, there is an ongoing need to improve the efficiency of fuel oil atomizers which supply fuel oil to a furnace. In particular, it is well known that "heavy" fuel oil (e.g., heavy number 6 oil or "bunker" oil), which contains organically bound nitrogen and sulfur compounds and has a high asphaltene content, is difficult to combust while producing low air polluting emissions. Particulate matter (PM) in the form of ash and unburned carbon, carbon monoxide (CO) or partially oxidized carbon, oxides of nitrogen (NOx), and opacity are in particular troublesome air emissions for many furnaces burning heavy oil. It is known that the formation of $NO_x$ can be reduced by providing fuel-rich and fuel-lean zones in the atomizing spray pattern.

Prior art atomizers, such as those disclosed in U.S. Pat. Nos. 5,860,600 and 5,826,798 to Schindler which have been assigned to Todd Combustion, Inc. (referred to herein as the "Todd patents"), are designed to provide improved emission performance. Both Todd patents comprise alleged improvements over prior art atomizers having a cup-shaped internal whirling chamber into which fuel under pressure is delivered through an array of passages or slots that are arranged tangentially to the whirling chamber. An array of discharge holes, each of which is the same radial distance from the center of the whirling chamber, provides for passage of the fuel from the whirling chamber to the furnace combustion chamber.

U.S. Pat. No. 5,826,798 discloses an atomizer design wherein the atomizer is provided with an array of discharge holes located a distance from the atomizer whirling chamber greater than 400/512 times the radius of the whirling chamber.

U.S. Pat. No. 5,860,600 discloses an atomizer design wherein the atomizer is provided with two arrays of discharge holes adjacent and offset from each other.

However, prior art atomizer designs of the type disclosed in the Todd patents and other prior art may be subject to premature wear, causing fuel pressure and fuel flow imbalances, leading to opacity excursions and increased NOx levels.

It would be advantageous to provide apparatus and methods for atomizing fuel oil which reduce NOx emissions over that obtained by the prior art, while also improving or maintaining CO, PM and opacity generation. It would be particularly advantageous to provide for such improvements in emissions while also increasing the durability of the atomizer components. The methods and apparatus of the present invention provide the above-mentioned and other advantages.

SUMMARY OF THE INVENTION

The present invention relates to improvements over prior art fuel oil atomizers. More particularly, the present invention relates to an improvement over the atomizer designs disclosed in the Todd patents. The improvements of the present invention provide reduced emissions as compared to the designs of the Todd patents, while at the same time providing increased durability of the atomizer components as compared to the prior art Todd atomizer designs.

The prior art atomizer designs of the type disclosed in the Todd patents may be subject to premature wear, causing fuel pressure and fuel flow imbalances, leading to opacity excursions and increased NOx levels.

The atomizer of the type under consideration has a centrally disposed whirling chamber into which fuel under pressure is delivered and one or more arrays of discharge holes provide openings from the centrally disposed whirling chamber to the combustion chamber. The discharge holes are arranged at an angle to the centerline of the centrally disposed whirling chamber.

The present invention provides specific design dimensions for the sprayer plate restrictor orifices and the resulting size of the atomized liquid spray pattern. Specific depth to diameter ratios of the sprayer plate restrictor orifices and specific dimensions of the chamfer of the inlet to the restrictor orifices of the present invention provide significant performance improvements as compared to the prior art Todd patent designs.

It has been found in connection with the present invention that depth to diameter ratio of the sprayer plate restrictor orifices, and the depth and orientation of the chamfer of the inlets to the restrictor orifices, are critical to fuel flow performance and wear resistance of the atomizer and its components.

The improvement of the present invention includes a depth to diameter ratio of the restrictor orifices in the range of 0.8:1.0 to 1.2:1.0. A preferred depth to diameter ratio has been found to be 1.0:1.0. The ball mill used to chamfer the inlet to the restrictor orifices must be concentric with the orifice hole and have a diameter between about 2.0 and 2.2 times the diameter of the hole. An optimal chamfer depth has been found to be approximately 0.015 inches.

The present invention provides a longer and more wear resistant constant diameter flow restrictor or metering orifice, with a shorter diffusing section and smaller exit orifice as compared with the design of the Todd patents. These characteristics provide a more defined and radially compact atomized jet of fuel for improved NOx control.

Additional modifications include a 16 RMS (Root Mean Square) polished surface finish in the whirling chamber pocket and use of a CPM-M4 material heat treated through a multiple drawing (tempering) process to a hardness of Rc53 (a Rockwell hardness test measurement) that also aides in the performance and wear resistance characteristics of the present invention. CPM-M4 is a metal manufactured by Crucible Materials Corporation using a crucible particle metallurgy (CPM) process. The designation "M4" denotes a durable tool steel made by the CPM process which is resistant to cracking and thermal stress.

The present invention may be implemented in an atomizer having a single array of discharge holes or in an atomizer having two or more arrays of discharge holes which arrays are adjacent and offset from each other.

BRIEF DESCRIPTION OF THE DRAWINGS

The present invention will hereinafter be described in conjunction with the appended drawing figures, wherein like numerals denote like elements, and:

FIG. 14A shows a comparison of the excess oxygen operating requirements;

FIG. 14B shows a comparison of output opacity; and

FIG. 14C shows a comparison of NOx emissions.

DETAILED DESCRIPTION OF THE INVENTION

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing a preferred embodiment of the invention. It should be understood that various changes may be made in the function and arrangement of elements without departing from the spirit and scope of the invention as set forth in the appended claims.

Figure 1:
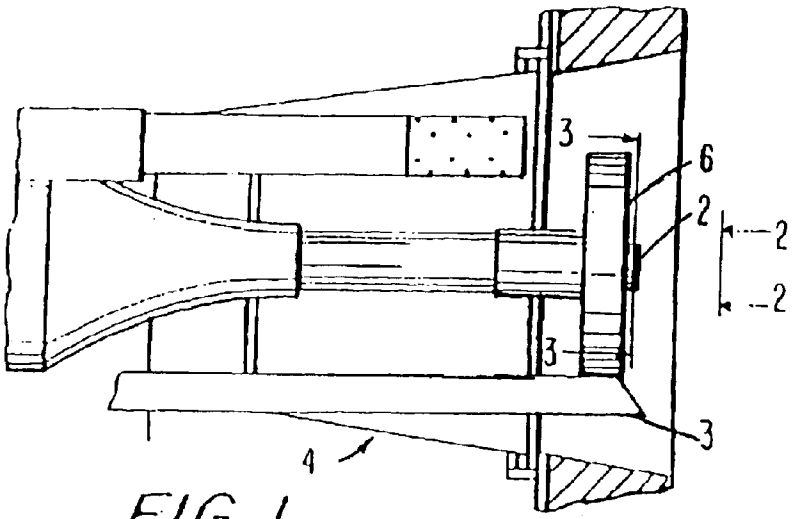
FIG. 1 is an example partial sectional view of a furnace burner in which the atomizer of the present invention may be used.

One embodiment of the invention having a single array of discharge holes is shown in FIGS. 1–4. As shown in FIG. 1, the atomizer 2 of the present invention is centrally disposed in a power plant furnace burner 4. The burner includes a conventional swirler 6 and an array of gas burning poker tubes 3 arranged around the swirler 6.

Figure 2:
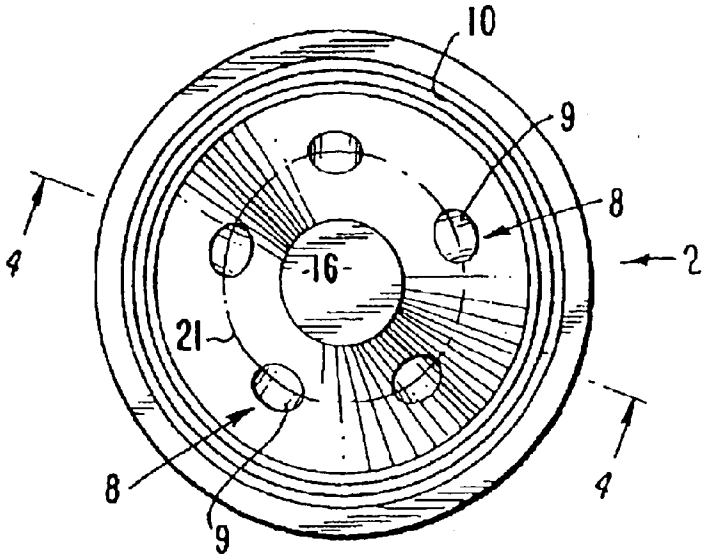
FIG. 2 is a front view of an example embodiment of the inventive atomizer taken through line 2—2 of FIG. 1.
Figure 4:
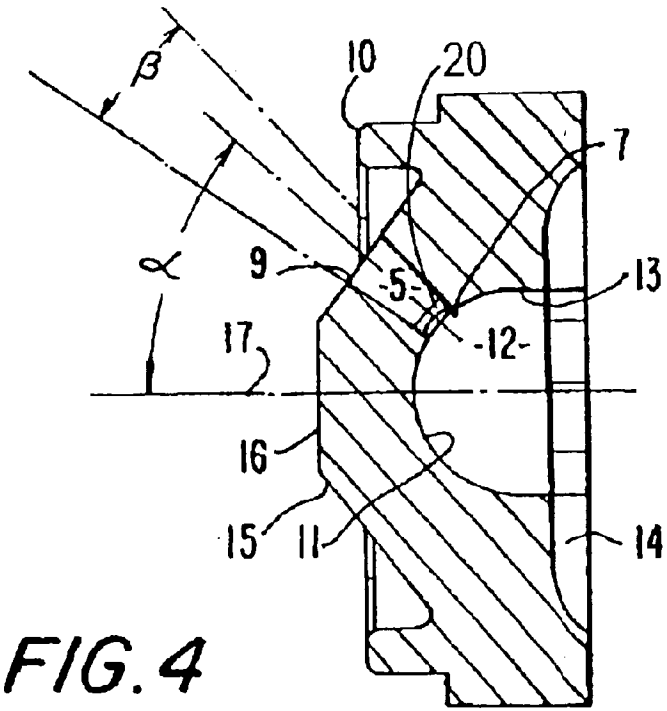
FIG. 4 is a sectional view of an example embodiment of the inventive atomizer taken through line 4—4 of FIG. 2.
Figure 3:
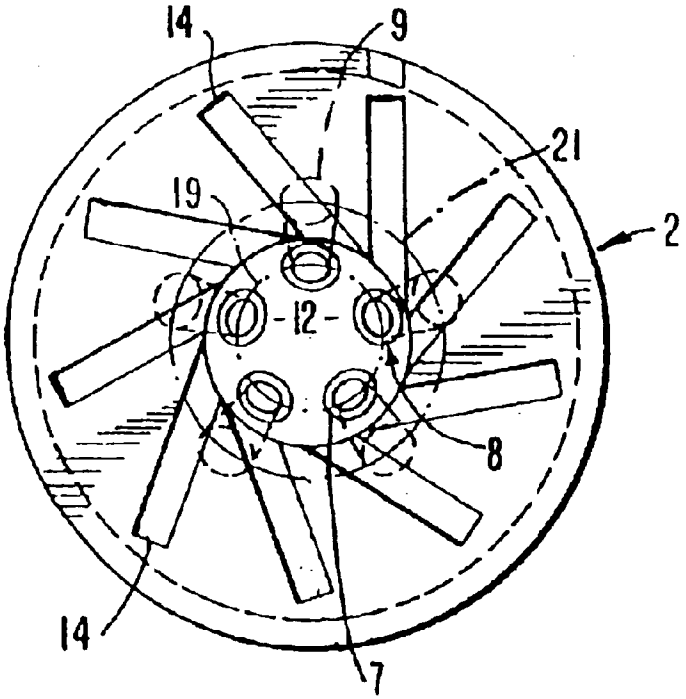
FIG. 3 is a back view of an example embodiment of the inventive atomizer taken through lines 3—3 of FIG. 1.

The atomizer 2, as shown in FIGS. 2–4, is provided with a circular array of discharge holes 8, an external circular flange 10, an internal centrally disposed chamber 12 and a plurality of slots 14 terminating tangentially at the inside upstream opening of the centrally disposed whirling chamber 12. The front surface of the atomizer 2 is a frusto-conical surface 15 terminating in a central circular flat surface 16.

As shown in FIGS. 2 and 4, the array of discharge holes 8 comprise five holes equidistant from the centerline 17 of the centrally disposed whirling chamber 12 and from each other. The discharge holes 8 are formed at an angle $\alpha$ in the range of 25° to 60° and preferably in the range of 35° of 40° to the centerline 17 of the whirling chamber. The whirling chamber 12 is formed in a cup-like configuration. The downstream section 11 of the whirling chamber 12 is hemi-spherical and the upstream section 13 is cylindrical. Each of the five discharge holes 8 has an inner upstream opening 7 (also referred to herein as inlet 7) leading into a restrictor orifice 20. The restrictor orifice 20 leads into a divergent passage or diffusion section 5 having a total divergence angle $\beta$, which in turn leads to an outer downstream opening 9, as best seen in FIG. 4. FIG. 3 shows the divergent passages 5 and outer downstream openings 9 in phantom. Each restrictor orifice 20 may have a depth to diameter ratio in the range of 0.8:1.0 to 1.2:1.0. A preferred depth to diameter ratio has been found to be 1.0:1.0. The inlets to the restrictor orifices (inner upstream opening 7) are configured in a partial hemi-spherical shape. The ball mill used to chamfer the inlet to the restrictor orifices must be concentric with the orifice hole and have a diameter between two and two-point-two times the diameter of the hole. An optimal chamfer depth has been found to be approximately 0.015 inches.

Figure 5:
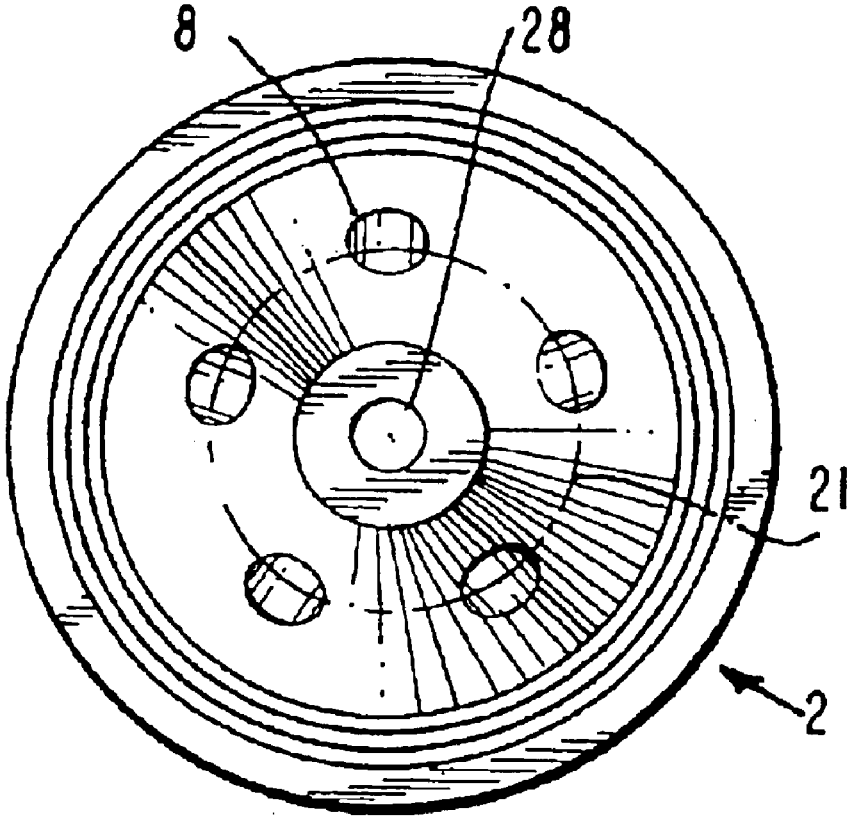
FIG. 5 is a front view of a further example embodiment of the inventive atomizer.

The embodiment of the atomizer 2 of FIG. 5 is essentially the same as the embodiment of FIGS. 2–4 but includes a centrally disposed through hole 28.

Figure 7:
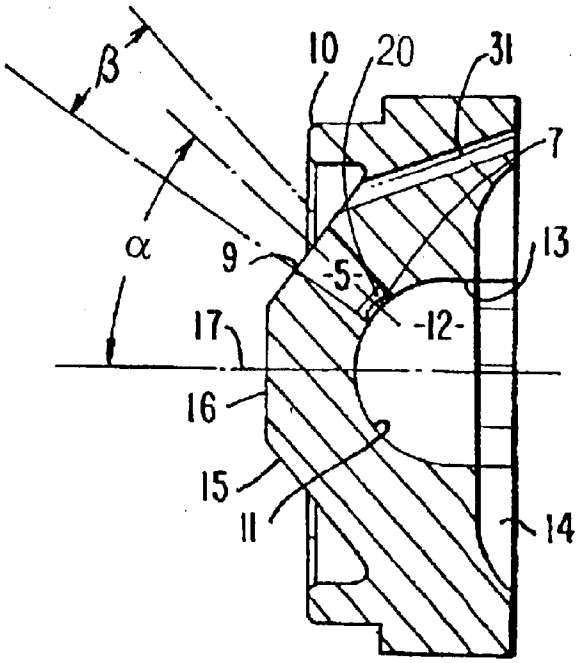
FIG. 7 is a sectional view of the atomizer of FIG. 6 taken through lines 7—7 of FIG. 6.
Figure 6:
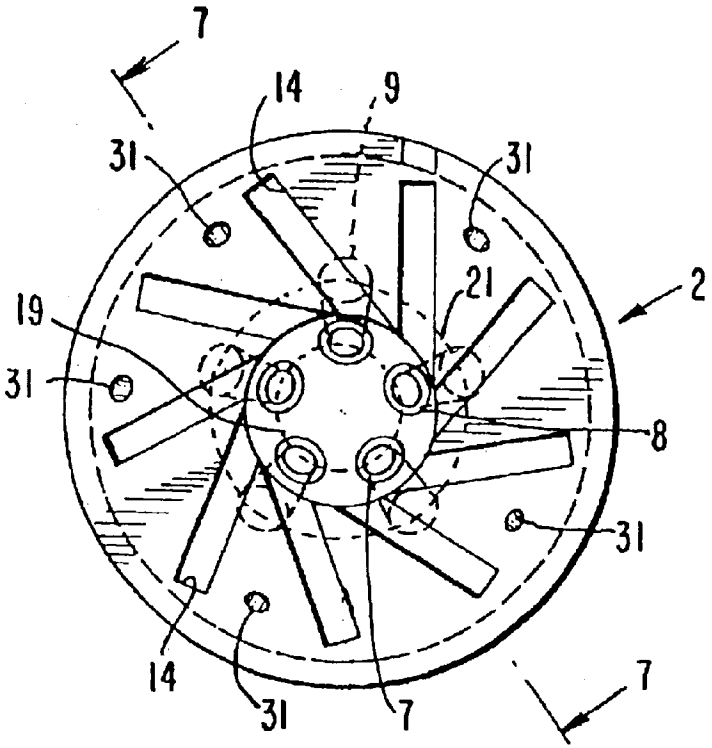
FIG. 6 is a back view of a further example embodiment of the inventive atomizer having compressed air delivery holes.
Figure 9:
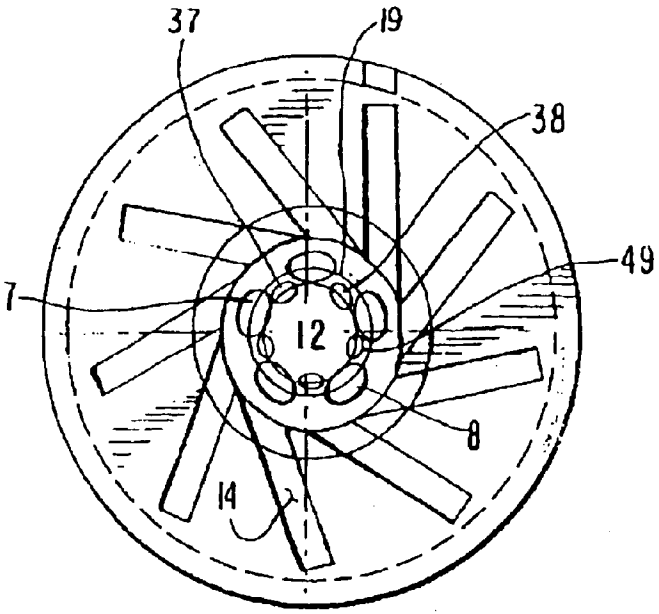
FIG. 9 is a back view of a further example embodiment of the inventive atomizer taken through lines 3—3 of FIG. 1.

In the embodiment of FIGS. 6 and 7 an array of passages 31 are provided to deliver compressed air or steam in the range of 60 to 150 psi for the purpose of enhancing atomization as the oil pressure is reduced.

In a particular example embodiment of the atomizers shown in FIGS. 2–7, the diameter of the cylindrical section 13 may be 0.512 inches and the radius of the hemi-spherical section 11 may be 0.256 inches. The diameter of a pitch circle 19 made through the center lines of the discharge holes 8 at the inner upstream opening 7 may be 0.350 inches. The diameter of the pitch circle 21 made through the centerline of the outside downstream openings 9 of the discharge holes 8 may be 0.680 inches. The restrictor orifices 20 may be 0.080 inches in length with a 0.104 inch diameter, for a depth to diameter ratio of approximately 0.77:1. The inner upstream opening 7 of each discharge hole 8 may be formed by a ball mill having a ¼ inch diameter penetrating 0.015 inches into the restrictor orifices 20. The diameter of the chamfer may be 0.174 inches, with the chamfer concentric with the hole 8. The divergence angle $\beta$ of the divergent passages may be 12°.

In operation, heated oil under pressure up to 1200 psig, is directed by a backing plate to the outer perimeter of the rear of the atomizer nozzle 2. The oil under pressure enters the atomizer 2 at the outer edge of the slots 14 cut in the rear of the atomizer 2. The oil is accelerated to high velocity in the slots 14, and jets into the whirling chamber 12 at an angle almost tangent to the outer diameter of the whirling chamber 12. This produces a high velocity rotating flow in the chamber that accelerates as the oil proceeds to the discharge holes 8. Oil passes through the discharge holes 8, where atomization occurs from a combination of centrifugal force and shearing of the oil by air as it jets into the air stream.

The embodiment of FIG. 5 functions similarly to the embodiment of FIGS. 3–5, but fluidized fuel also discharges from the centrally disposed through hole 28. At the exit of the center through hole 28, the swirling oil forms a thin film around the perimeter of the hole, which atomizes the oil into small droplets. Centrifugal force from the swirling oil causes the oil to be discharged from the discharge holes 8 in an enlarging fan pattern, which results in small droplets that ignite easily.

Although the embodiments of the invention shown in FIGS. 2–7 have only 5 discharge holes, those skilled in the art will appreciate that the number and arrangement of holes may vary depending on the application and implementation of the invention.

In an alternate example embodiment of the invention, two or more adjacent and offset arrays of discharge holes are provided.

The atomizer 2, as shown in FIGS. 8–12, is provided with a first array of discharge holes 8 and a smaller diameter second array of discharge holes 38, an external circular flange 10, an internal centrally disposed whirling chamber 12 and a plurality of slots 14 terminating tangentially at the inside upstream opening of the centrally disposed chamber 12. The front surface of the atomizer 2 is a frusto-conical surface 15 terminating in a central circular flat surface 16. The whirling chamber 12 is formed in a cup-like configuration. The downstream section 11 of the whirling chamber 12 is hemi-spherical and the upstream section 13 is cylindrical.

Figure 11:
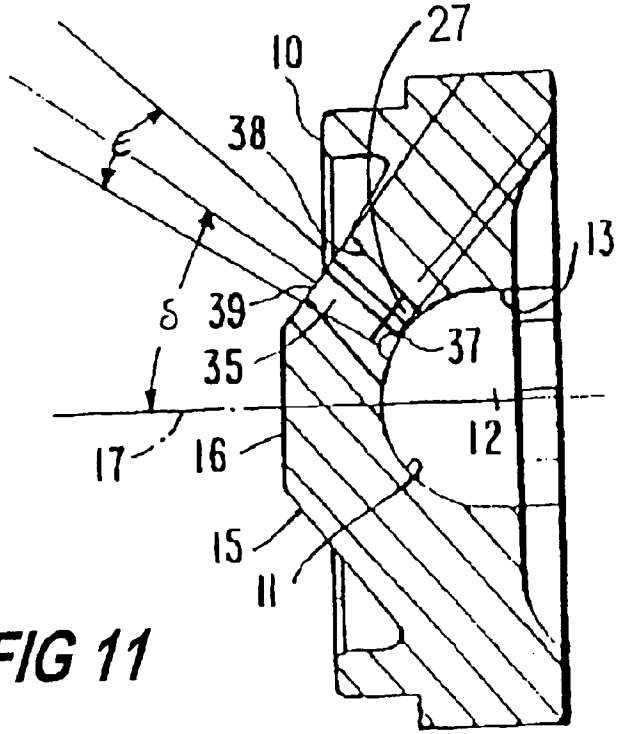
FIG. 11 is a sectional view of an example embodiment of the inventive atomizer taken through line 5—5 of FIG. 8.

As shown in FIGS. 8–11, the array of discharge holes 8 comprises five holes equidistant from the centerline 17 of the centrally disposed whirling chamber 12 and from each other. The array of discharge holes 38 also comprises five holes equidistant from the centerline 17 of the centrally disposed whirling chamber 12 and from each other. The discharge holes 8 are formed at an angle $\alpha$ in the range of 22.5° to 60° and preferably 40° to the centerline 17 of the whirling chamber 12, as best can seen in FIG. 10. As seen in FIG. 11, the discharge holes 38 are formed at an angle $\delta$ in the range of 22.5° to 60° and preferably 35° to the centerline 17 of the whirling chamber 12.

Figure 10:
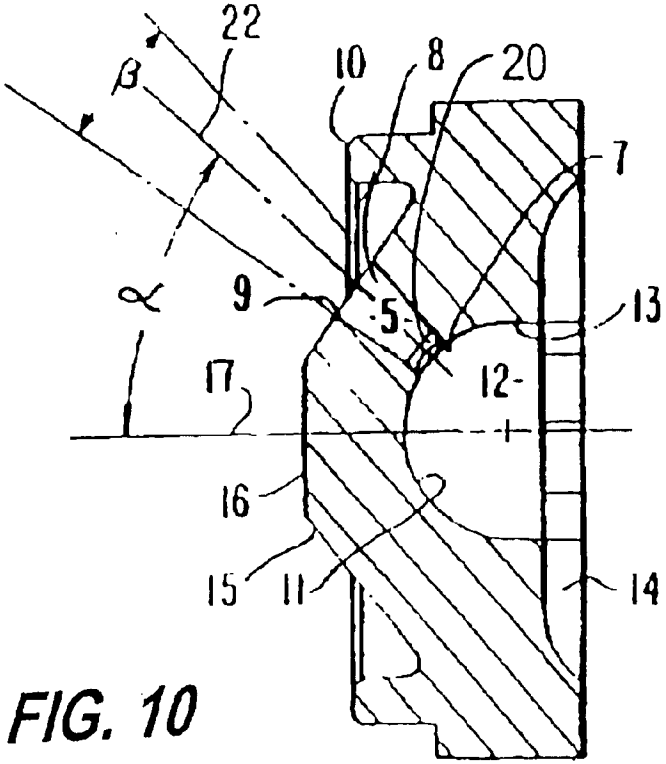
FIG. 10 is a sectional view of an example embodiment of the inventive atomizer taken through line 4—4 of FIG. 8.

As seen in FIG. 10 each of the five discharge holes 8 has an inner upstream opening 7 leading into a restrictor orifice 20. Each restrictor orifice 20 leads into a divergent passage or diffusion section 5 having a divergence angle $\beta$, which in turn leads to an outer downstream opening 9. As seen in FIG. 11 each of the discharge holes 38 has an inner upstream opening 37, an outer downstream opening 39, a restrictor orifice 27, and a divergent passage or diffusion section 35 having a divergence angle $\epsilon$.

Each restrictor orifice 20, 27 may have a depth to diameter ratio in the range of 0.8:1.0 to 1.2:1.0. A preferred depth to diameter ratio has been found to be 1.0:1.0. The inlets to the restrictor orifices (inner upstream openings 7, 37) are configured in a partial hemi-spherical shape. The ball mill used to chamfer the inlets 7, 37 to the restrictor orifices must be concentric with their respective holes 8, 38 and have a diameter between two and two-point-two times the diameter of the hole. An optimal chamfer depth has been found to be approximately 0.015 inches.

Figure 8:
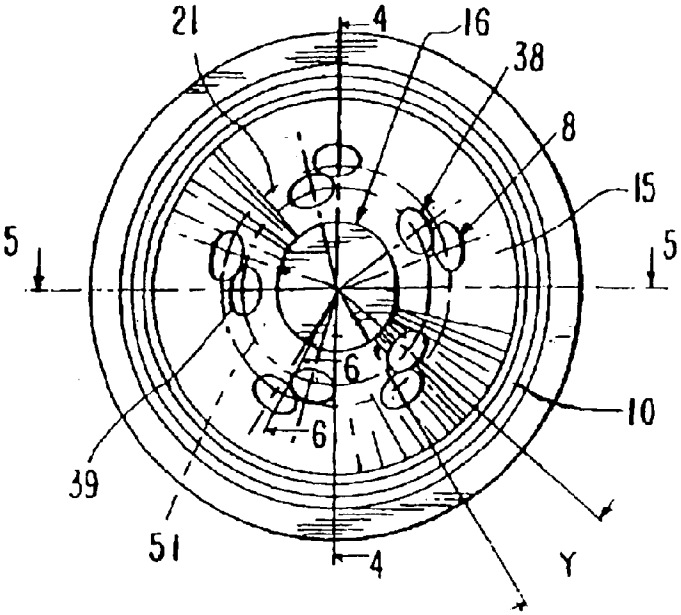
FIG. 8 is a front view of a further example embodiment of the inventive atomizer taken through line 2—2 of FIG. 1.

As shown in FIG. 8, each discharge hole 38 is adjacent to a discharge hole 8 and is offset at an angle $\gamma$ about the center of the atomizer 2.

Figure 12:
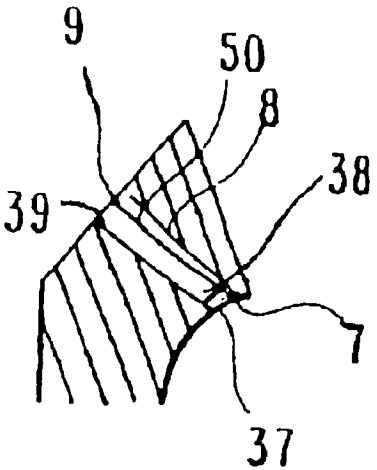
FIG. 12 is a partial sectional view of an example embodiment of the inventive atomizer taken through lines 6—6 of FIG. 8.

As shown in FIG. 12, a wall 50 separates the discharge holes 8 from the discharge holes 38.

Figure 13:
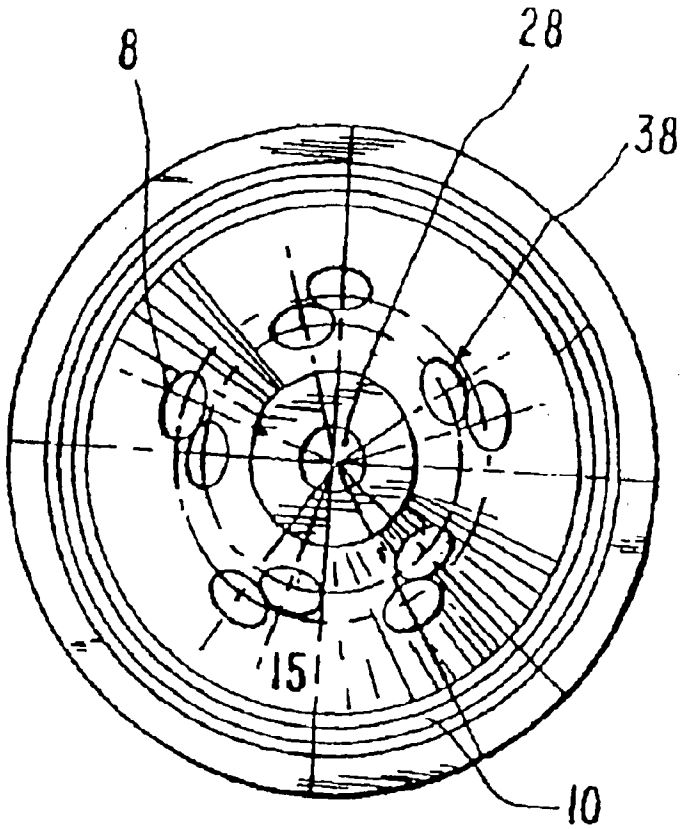
FIG. 13 is a front view of a further example embodiment of the inventive atomizer having a centrally disposed through hole.

The embodiment of the atomizer 2 of FIG. 13 is essentially the same as the embodiment of FIGS. 8–12 but includes a centrally disposed through hole 28.

In a particular example embodiment of the atomizers shown FIGS. 8–13, the diameter of the cylindrical section 13 may be in the range of 0.509 to 0.515 inches, with a preferred diameter of 0.512 inches. The radius of the hemi-spherical section 11 may be 0.256 inches. The diameter of a pitch circle 19 made through the center lines of the discharge holes 8 at the inner upstream opening 7, may be in the range of 0.361 to 0.384 inches, and the diameter of a pitch circle 21 made through the centerline of the outside downstream openings 9 of the discharge holes 8 may be 0.700 inches. The diameter of a pitch circle 49 made through the center lines of the discharge holes 38 at the inner upstream opening 37, may be in the range of 0.258 to 0.264 inches, and the diameter of a pitch circle 51 made through the center lines of the discharge holes 38 at the outer downstream opening 39 may be 0.570 inches. The divergence angle $\beta$ of passage 5 of the discharge holes 8 may be 12° and the divergence angle $\epsilon$ of the passages 35 of the discharge holes 38 may also be 12°. Each of the holes 8 and 38 may have an inlet opening 7 and 37 respectively formed with a partial hemi-spherical section, formed for example with a ball mill. For example, the inlet openings may be formed with a 3/32 inch ball mill that penetrates 0.015 inches into the restrictor orifices 20 and 27. The restrictor orifices may be 0.055 inches in length with a diameter of 0.0492 inches, for a depth to diameter ratio of approximately 1.12:1.

In an alternate example embodiment, the inlet openings may be formed with a 0.156 inch ball mill that penetrates 0.015 inches into the respective restrictor orifices 20 and 27 of passages 5 and 35. Each restrictor orifice 20, 27 may be 0.065 inches in length with a diameter of 0.076 inches, for a depth to diameter ratio of approximately 0.86:1.

The offset angle $\gamma$ between the holes of the arrays is in the range of 10° to 25°, preferably 18°.

In operation, oil under pressure up to 1200 psig, is directed by a backing plate (not shown) to the outer perimeter of the rear of the atomizer. The oil under pressure enters the atomizer 2 at the outer edge of the slots 14 cut in the rear of the atomizer 2. The oil is accelerated to high velocity in the slots 14, and jets into the whirling chamber 12 at an angle almost tangent to the outer diameter of the whirling chamber 12. This produces a high velocity rotating flow in the whirling chamber 12 that accelerates as the oil proceeds to the discharge holes 8 and 38. Oil passes through the discharge holes 8 and 38, where atomization occurs from a combination of centrifugal force and shearing of the oil by air as it jets into the air stream.

The embodiment of FIG. 13 functions similarly to the embodiments of FIGS. 8–12, but fluidized fuel also discharges from the centrally disposed through hole 28 which may have a diameter of 3/16 to 5/16 inch. At the exit of the center through hole 28, the swirling oil forms a thin film around the perimeter of the hole, which atomizes the oil into small droplets. Centrifugal force from the swirling oil causes the oil to be discharged from the discharge holes 8 and 38 in an enlarging fan pattern, which results in small droplets that ignite easily.

Although the embodiments of the invention shown in FIGS. 8–13 have only two arrays of 5 discharge holes, those skilled in the art will appreciate that the invention may be implemented using varying numbers of holes and arrays with substantially similar results. For example, the invention may be implemented with an atomizer of the type disclosed in U.S. patent application Ser. No. 09/838,872 entitled "Fuel Oil Atomizer and Method for Discharging Atomized Fuel Oil" filed on Apr. 20, 2001.

A 16 RMS surface finish may be used in the whirling chamber pocket and the atomizer may be constructed of a CPM-M4 material heat treated through a multiple drawing (tempering) process to Rc53 to aide in the performance and wear resistance characteristics of the present invention.

Figure 14A:
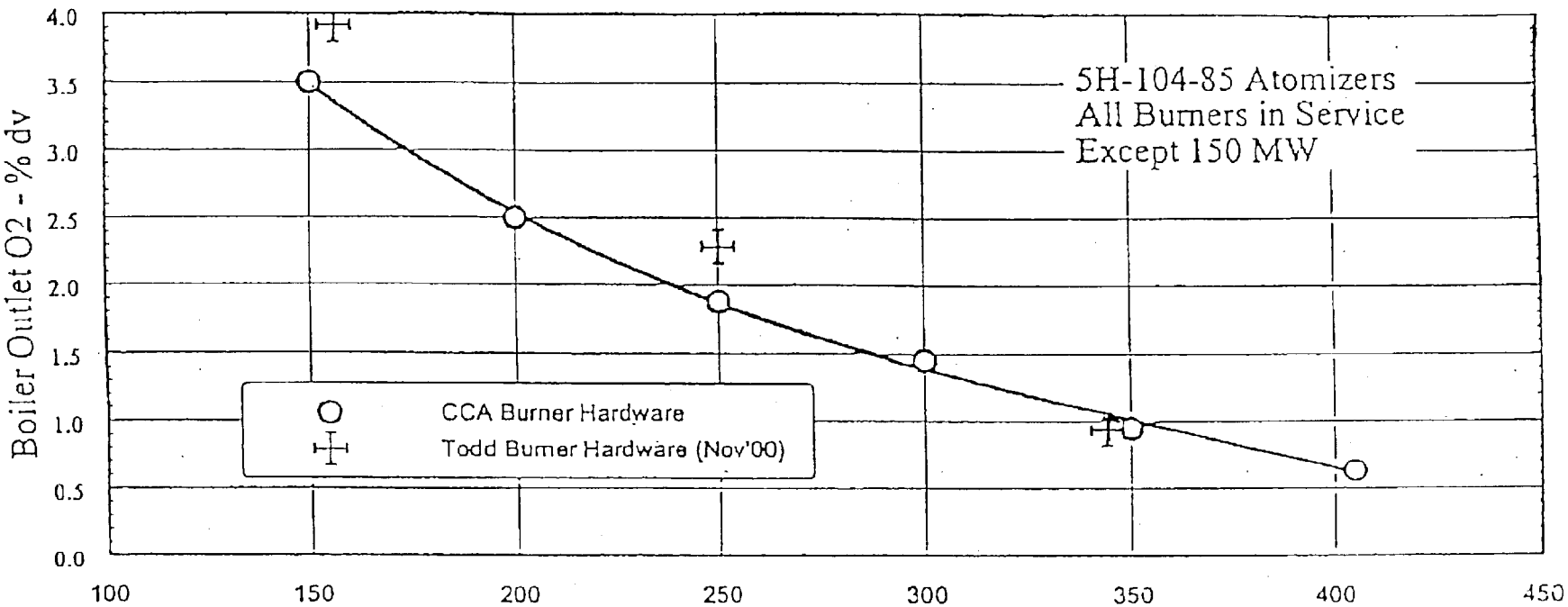
FIGS. 14A–14C show comparisons between the performance of the present invention and a prior art atomizer design.
Figure 14B:
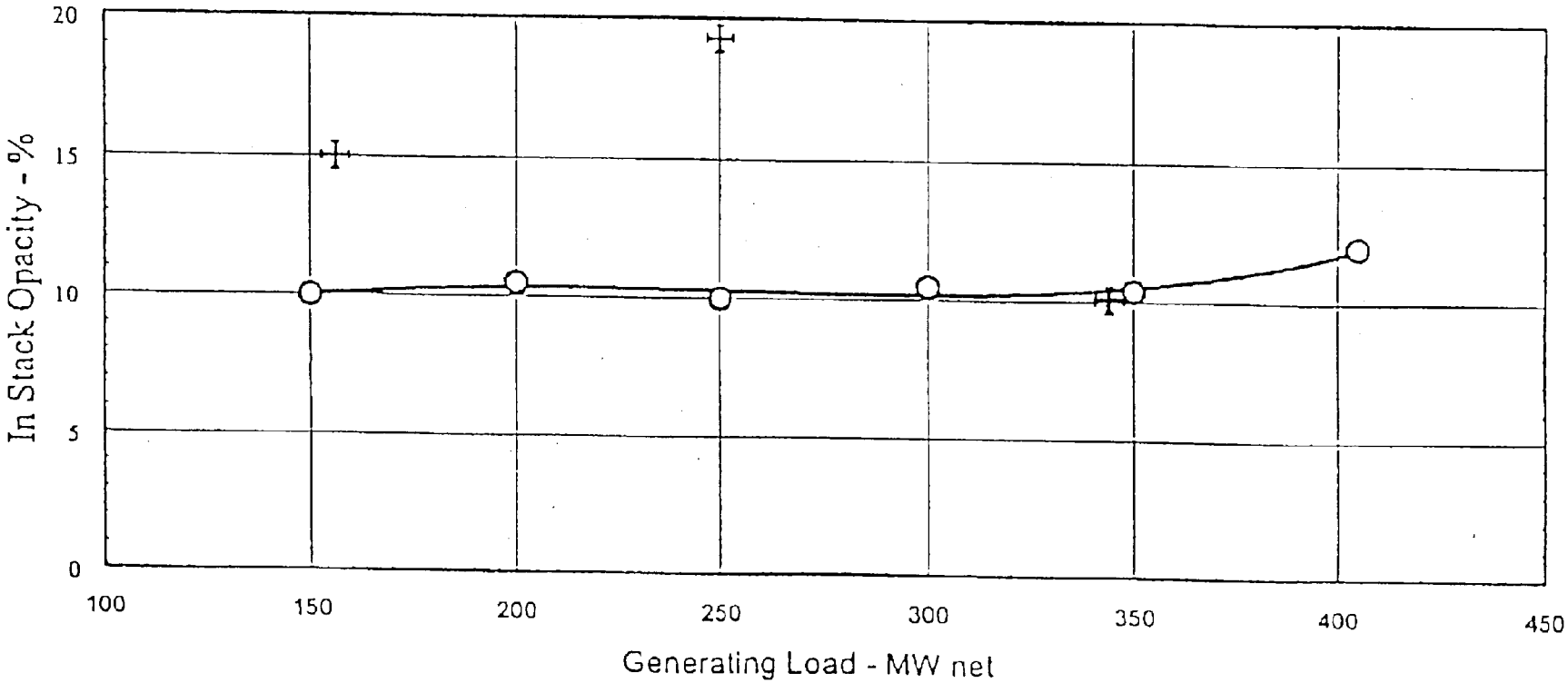
Figure 14C:
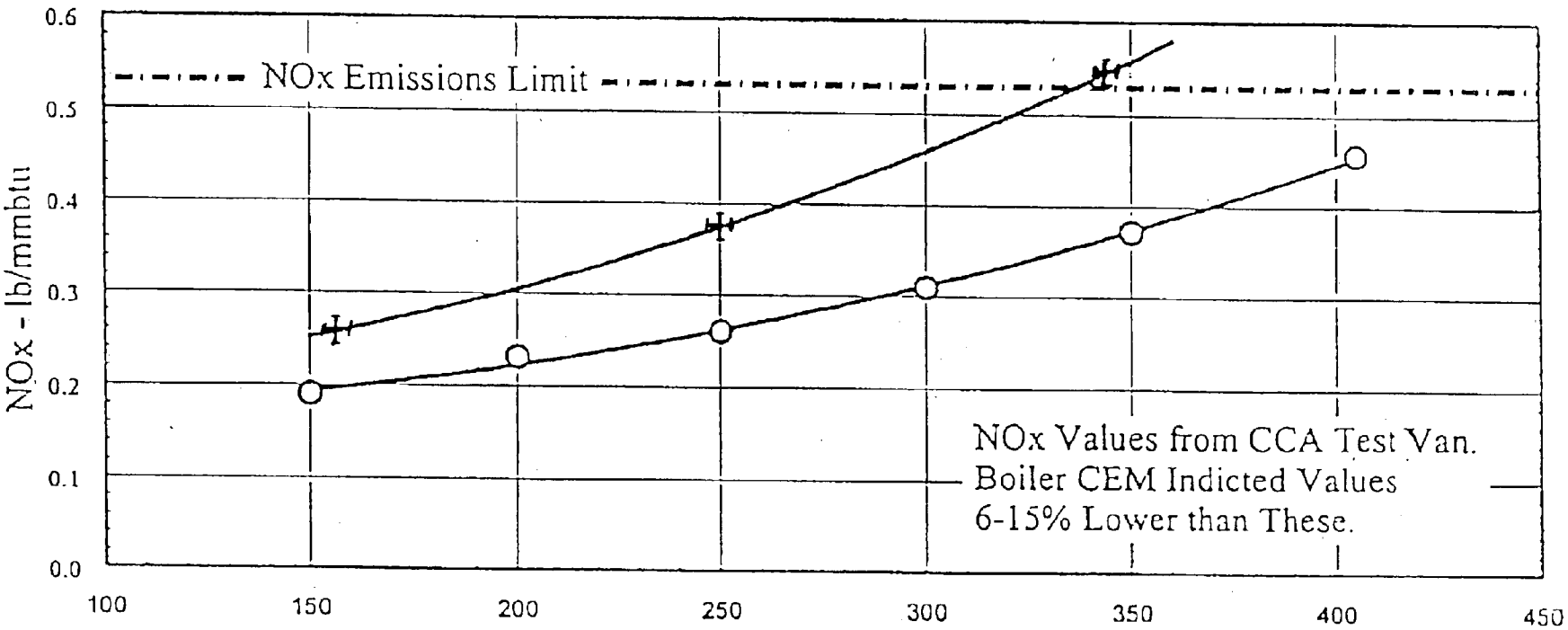

A performance comparison between the design of the Todd patents and the present invention yielded surprising and unexpected results, including substantial reductions in excess oxygen operating requirements, output opacity, and NOx emissions as shown in FIGS. 14A, 14B and 14C, respectively. In FIGS. 14A–14C, the results from the design of the present invention (CCA) are designated by "○" and the results from the Todd design are designated by "⊠". Further, the present invention has resulted in improved wear resistance on the order of three to four times greater than the prior art designs.

It should now be appreciated that the present invention provides advantageous methods and apparatus for obtaining reductions in NOx emissions over that obtained by the prior art, while also improving or maintaining CO, PM and opacity generation. The invention also increases the durability of the atomizer components.

Although the invention has been described in connection with various illustrated embodiments, numerous modifications and adaptations may be made thereto without departing from the spirit and scope of the invention as set forth in the claims.

What is claimed is:

1. A fuel oil atomizer comprising:

a whirling chamber;

at least one array of discharge holes arranged around the centerline of the whirling chamber and inclined at an angle to a centerline of the whirling chamber; and each discharge hole being comprised of an upstream inlet opening, a restrictor orifice, a downstream outlet opening, and a divergent passage that diverges from the upstream inlet opening to the downstream outlet opening;

wherein;

a depth to diameter ratio of each restrictor orifice is in the range of approximately 0.8:1.0 to 1.2:1.0; and each of said inlet openings comprises a chamfered opening having a depth of approximately 0.015 inches.

2. Atomizer in accordance with claim 1, wherein:

at least two arrays of discharge holes are arranged around the centerline of the whirling chamber; and each discharge hole of each array of discharge holes is offset from a corresponding discharge hole of an adjacent array of discharge holes.

3. Atomizer in accordance with claim 1, further comprising:

a centrally disposed discharge hole.

4. Atomizer in accordance with claim 1, wherein the depth to diameter ratio is approximately 1.0:1.0.

5. Atomizer in accordance with claim 1, wherein the depth to diameter ratio is approximately 0.86:1.0.

6. Atomizer in accordance with claim 1, wherein the depth to diameter ratio is approximately 1.12:1.0.

7. Atomizer in accordance with claim 1, wherein said atomizer comprises CPM-M4 material heat treated through a multiple drawing process to Rc53.

8. Atomizer in accordance with claim 1, wherein the whirling chamber has a 16 RMS surface finish.

* * * * *